US007013963B2

(12) United States Patent
Laine et al.

(10) Patent No.: US 7,013,963 B2
(45) Date of Patent: Mar. 21, 2006

(54) ROUND PLATE HEAT EXCHANGER WITH IMPROVED HEAT EXCHANGE PROPERTIES

(75) Inventors: Jouko Laine, Tampere (FI); Mauri Kontu, Kalanti (FI)

(73) Assignee: Vahterus Oy, Kalanti (FI)

( * ) Notice: Subject to any disclaimer, the term of this patent is extended or adjusted under 35 U.S.C. 154(b) by 0 days.

(21) Appl. No.: 10/499,983

(22) PCT Filed: Dec. 27, 2002

(86) PCT No.: PCT/FI02/01058

§ 371 (c)(1),
(2), (4) Date: Aug. 12, 2004

(87) PCT Pub. No.: WO03/056267

PCT Pub. Date: Jul. 10, 2003

(65) Prior Publication Data

US 2005/0039896 A1 Feb. 24, 2005

(30) Foreign Application Priority Data

Dec. 27, 2001 (FI) ..... 20012575

(51) Int. Cl.
*F28D 9/00* (2006.01)

(52) U.S. Cl. ..... 165/157; 165/159; 165/166

(58) Field of Classification Search ..... 165/157, 165/159, 164–166
See application file for complete search history.

(56) References Cited

U.S. PATENT DOCUMENTS

| | | | | |
|---|---|---|---|---|
| 2,777,674 | A | 1/1957 | Wakeman | |
| 5,088,552 | A | 2/1992 | Raunio | |
| 5,179,999 | A | 1/1993 | Meekins et al. | |
| 5,203,832 | A | 4/1993 | Beatenbough et al. | |
| 5,343,936 | A | 9/1994 | Beatenbough et al. | |
| 5,823,253 | A | 10/1998 | Kontu | |
| 6,199,626 | B1 * | 3/2001 | Wu et al. | 165/167 |

FOREIGN PATENT DOCUMENTS

| | | |
|---|---|---|
| DE | 2639371 A | 3/1977 |
| FI | 84659 | 6/1991 |
| FI | 79409 | 2/1992 |
| WO | WO 91/09262 | 6/1991 |
| WO | WO 99/30099 | 6/1999 |
| WO | WO 00/39516 | 7/2000 |

* cited by examiner

*Primary Examiner*—Teresa J. Walberg
(74) *Attorney, Agent, or Firm*—Nixon & Vanderhye, PC

(57) ABSTRACT

The invention relates to a method and a device for improving heat transfer in a circular plate heat exchanger (1), as well as a heat transfer plate to be used therein. The invention is based on changing the flow conditions in the radial direction in such a way that the heat transfer remains even. The ridges between the grooves of the heat transfer plates (10) may be, in their shape, evolvent graphs or the like.

10 Claims, 4 Drawing Sheets

ROUND PLATE HEAT EXCHANGER WITH IMPROVED HEAT EXCHANGE PROPERTIES

Figure 1:
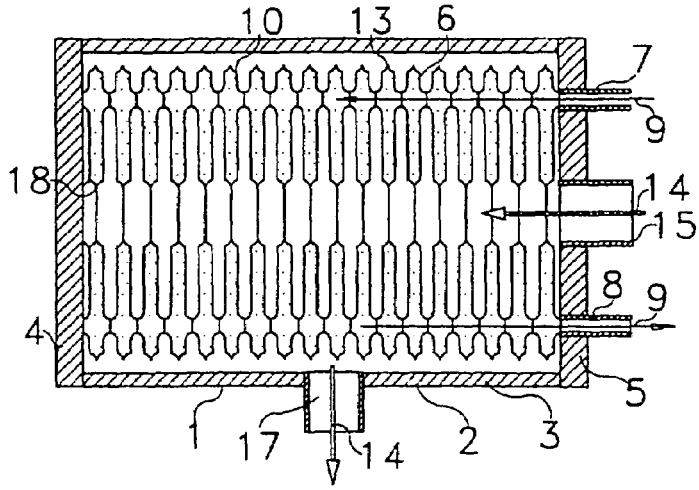

This application is the U.S. national phase of international application PCT/F102/01058 filed 27 Dec. 2002 which designated the U.S. and claims benefit of FI 20012575, dated 27 Dec. 2001, the entire content of which is hereby incorporated by reference.

The invention relates to a method and a device for improving heat transfer in a plate heat exchanger composed of circular heat transfer plates, in which the heat transfer takes place between heat transfer media, such as gaseous and/or liquid substances, i.e. fluids, flowing in spaces between the heat transfer plates, in a circular plate heat exchanger which comprises a stack of plates fitted in a frame part and consisting of circular grooved heat transfer plates, which heat transfer plates are provided, at least in the direction of the diameter of the plate, with holes on, regarding each other, opposite sides of the heat transfer plate, and its central part can be provided with a hole for conducting heat transfer media in and out of the spaces between the plates. The invention also relates to a heat transfer plate.

Conventional plate heat exchangers have the shape of a rectangle with rounded edges. The heat transfer plates have typically been provided with four holes for the primary and the secondary streams. The stack of plates is sealed with rubber sealings or the like, and tensioned by clamp bolts between end plates. In such heat exchangers, the cross-section of the stream is almost constant over the whole travel length of the stream. In particular, this applies to such plate heat exchangers with plates of a long and narrow shape. The heat transfer plates are normally provided with radial or curved groovings around the openings of the primary and secondary streams, to distribute the streams as evenly as possible in the spaces between the heat transfer plates. Because the straight part of the heat exchangers is homogeneous with respect to the stream, the stream and the heat transfer are balanced in this part. A large variety of shapes and patterns is previously known for grooving the heat transfer plates. The most common groove patterns have been patterns formed of various straight elements, such as herringbone patterns or the like.

A disadvantage in plate heat exchangers equipped with sealings has been their poor resistance to pressure, temperature and corrosion. However, conventional tube heat exchangers have been placed inside a circular housing, which is advantageous in view of pressure vessel technology. Also circular plate heat exchangers are previously known, in which the stack of plates is fitted inside a circular housing. Plate heat exchanger assemblies of this type have been presented in, for example, FI patent publication 79409, FI patent publication 84659, WO publication 97/45689, and FI patent application 974476.

In the heat exchanger according to Finnish patent publication 79409, the stack of plates is composed of heat transfer plates welded to each other at their outer perimeters and having the shape of a circle or a regular polygon. The heat transfer plates do not comprise any holes, but the primary and secondary streams are introduced into the spaces between the heat transfer plates from their outer perimeters. The plates are provided with an even grooving on their whole surfaces. Because of the circular shape of the heat exchanger, the flow rates and the heat transfer properties vary at different points of the plate. In the solution according to WO publication 97/45689, the stack of plates composed of circular heat transfer plates is fitted inside a cylindrical housing as in the arrangement of FI publication 84659. In the arrangements of each publication, there are holes for the stream of a second heat transfer medium on the diameter, on opposite sides of the heat transfer plates. The heat exchanger constructions according to the above-presented publications have applied plates whose groovings are straight and extend linearly from one edge of the plate to another. The heat exchanger according to FI patent application 974476 differs from the other ones in that its heat transfer plates are provided with a central hole.

It is an aim of the present invention to provide a method and a device for improving the heat transfer of a heat exchanger, which is simple to implement and whereby an even heat transfer is achieved on a circular heat transfer plate.

A typical embodiment of the invention is based on the fact that the density or shape of groovings in the heat transfer plates, and/or the ridge angle $\alpha$ between groovings on adjacent plates are changed in the direction of the secondary stream of the heat transfer medium, to compensate for changes caused by the circular plate under the flow conditions of the heat transfer medium. Using circular heat transfer plates provided with a central hole, in the cases of radial flow, the flow cross-section is typically either increased or decreased, depending on whether the flow is directed towards or away from the central hole in the heat transfer plate. However, when using heat transfer plates without a central hole, wherein the flows are parallel to the diameter, the flow cross-section is typically increased towards the centre of the heat transfer plate, after which it is reduced again.

To put it more precisely, the method and the device for improving heat transfer in a circular plate heat exchanger, as well as the heat transfer plate according to the invention, are characterized in what is presented in the characterizing parts of the independent cairns.

By means of the invention, significant advantages will be achieved in comparison with prior art. By means of circular heat transfer plates, efficient heat transfer is achieved on the whole transfer surface. The circular plate is characterized in that the flow in the radial direction is naturally decelerated when moving from the inner perimeter to the outer perimeter. In the method and the device according to the invention, the reduction in the heat transfer, caused naturally by the deceleration of the flow, is efficiently compensated for by fluid flow arrangements, such as turbulence and/or flow control, as well as various patterns on the heat transfer plates. A quadratic or diamond pattern formed by ridges between the grooves in adjacent heat transfer plates will provide mechanical supporting points at the end points of the rectangular pattern elements in the stack of plates. The pattern elements form a grate in which the internal mechanical support of the stack of plates will become strong and thereby resistant to a high pressure. The flow from the distribution channels to the spaces between the plates and to the outlet duct is implemented in such a way that the fluid will flow as evenly as possible in the different spaces between plates and at each point in each space between plates. The pressure loss in the flow of gas is insignificant, because there are no structures in the gas flow channels which would cause unnecessary pressure losses.

In a typical embodiment of the invention, without a central hole, the patterning of the plate consists of parts of a parabola, which cause strong pressure losses in the flow in the central part of the plate. By patterning the plate, it is possible to compensate for the differences caused by the lengths of flow in circular heat transfer plates.

Figure 2:
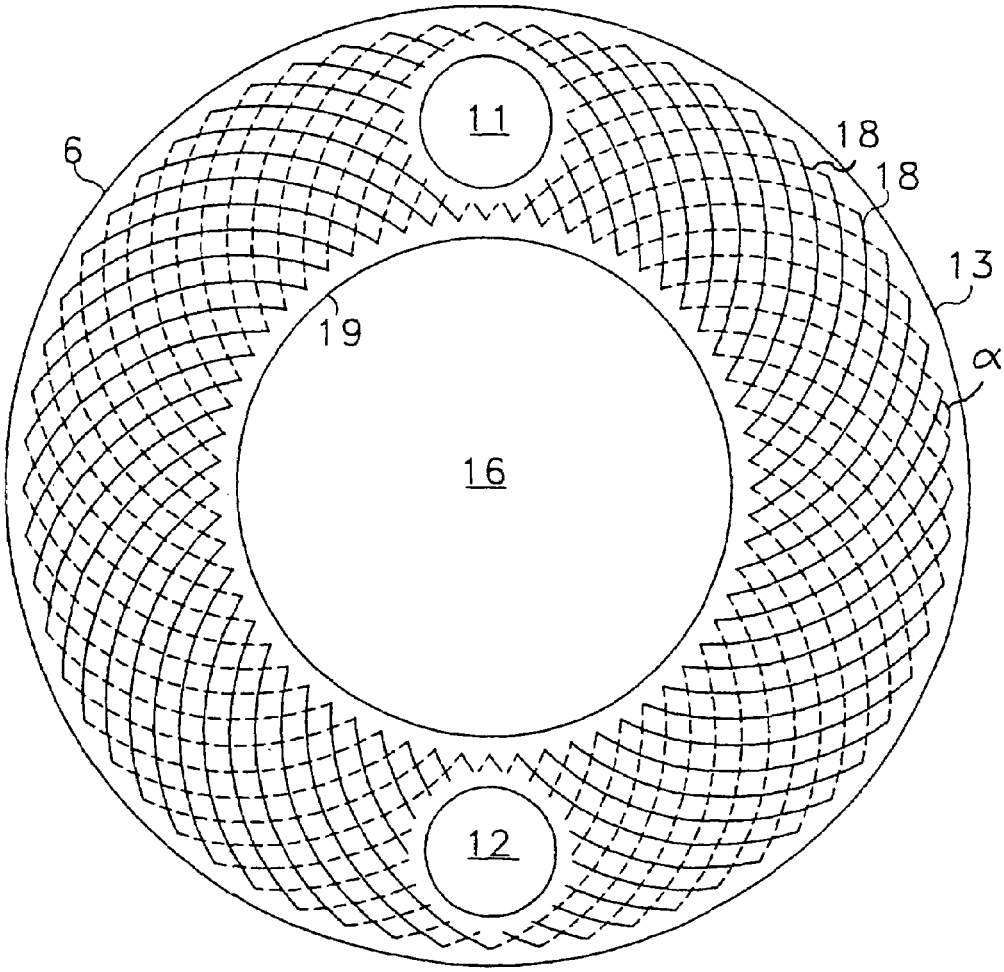
Figure 3:
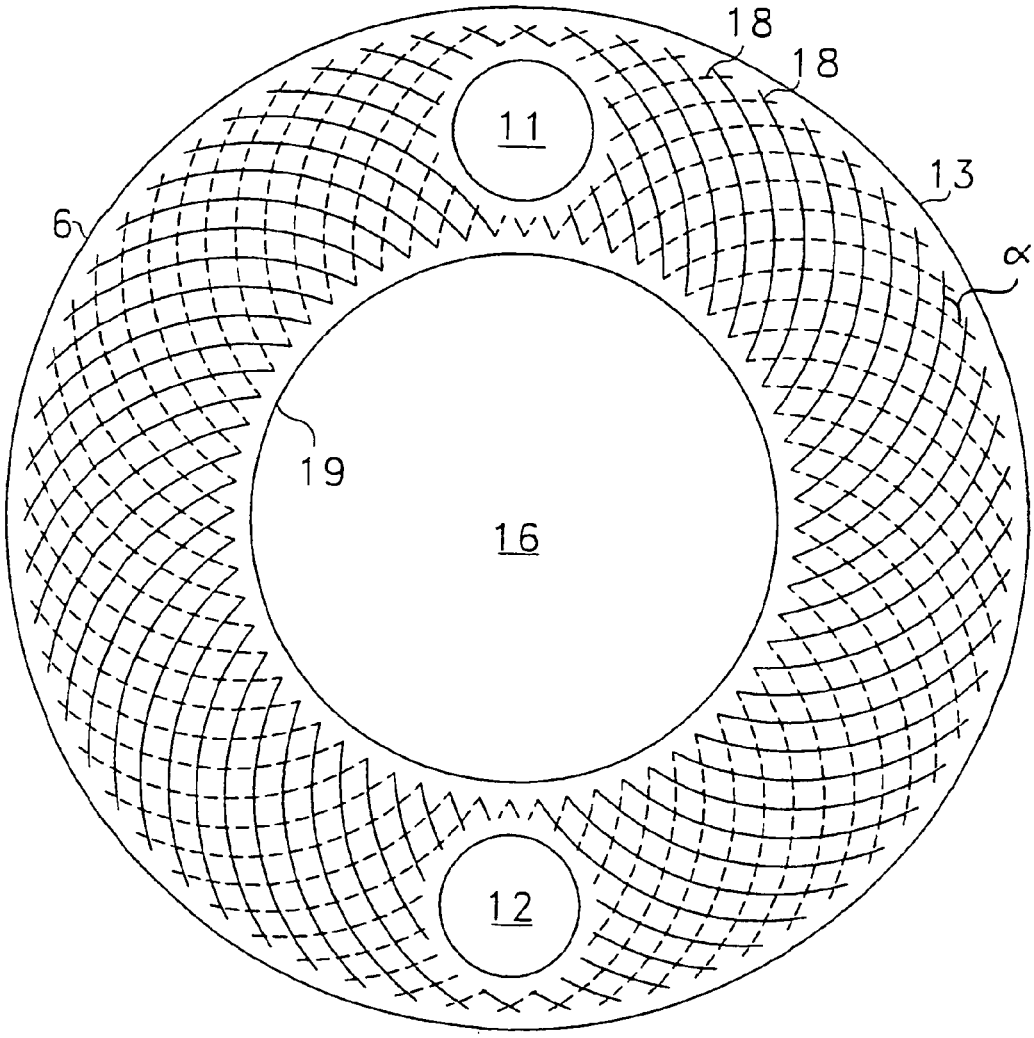
Figure 4:
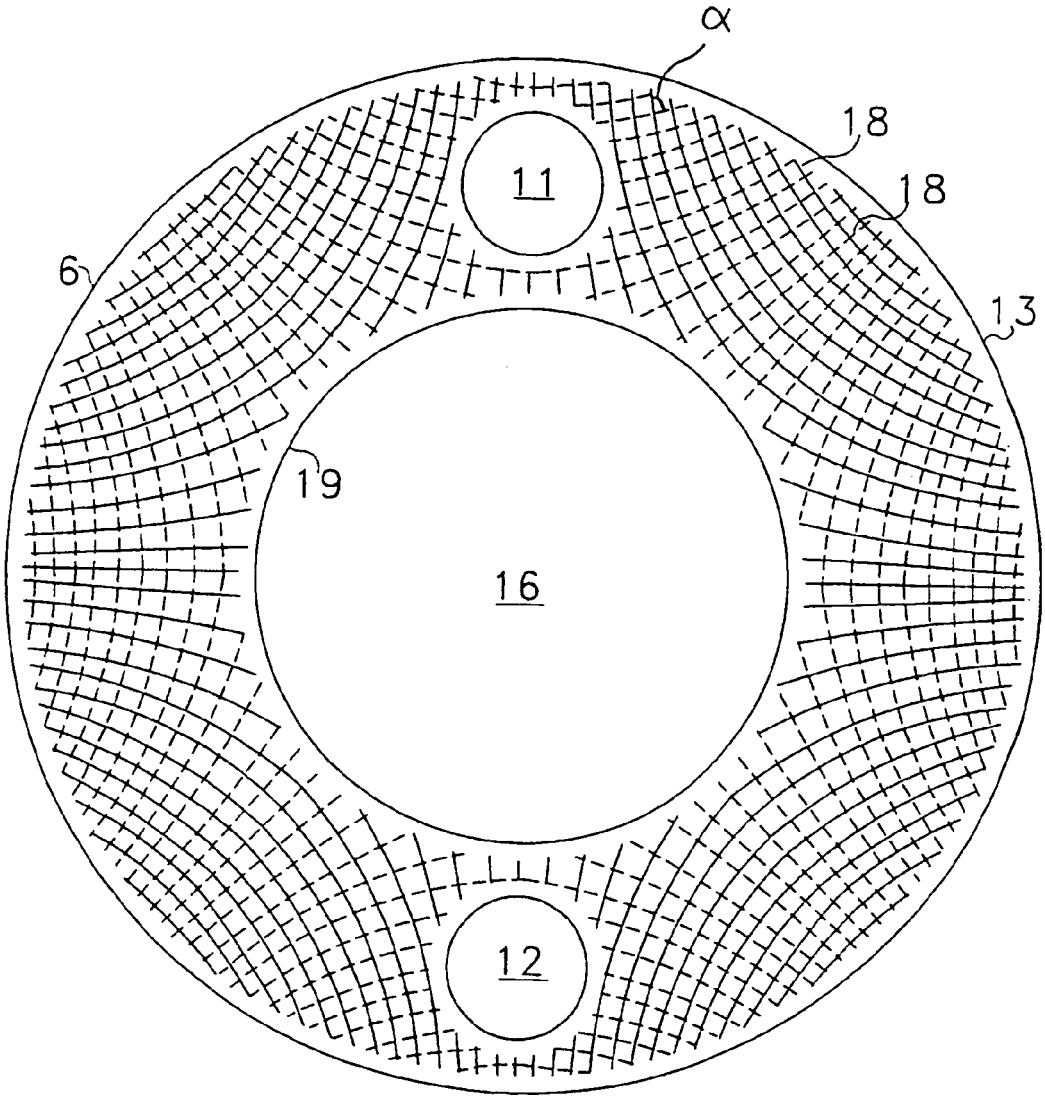
Figure 5:
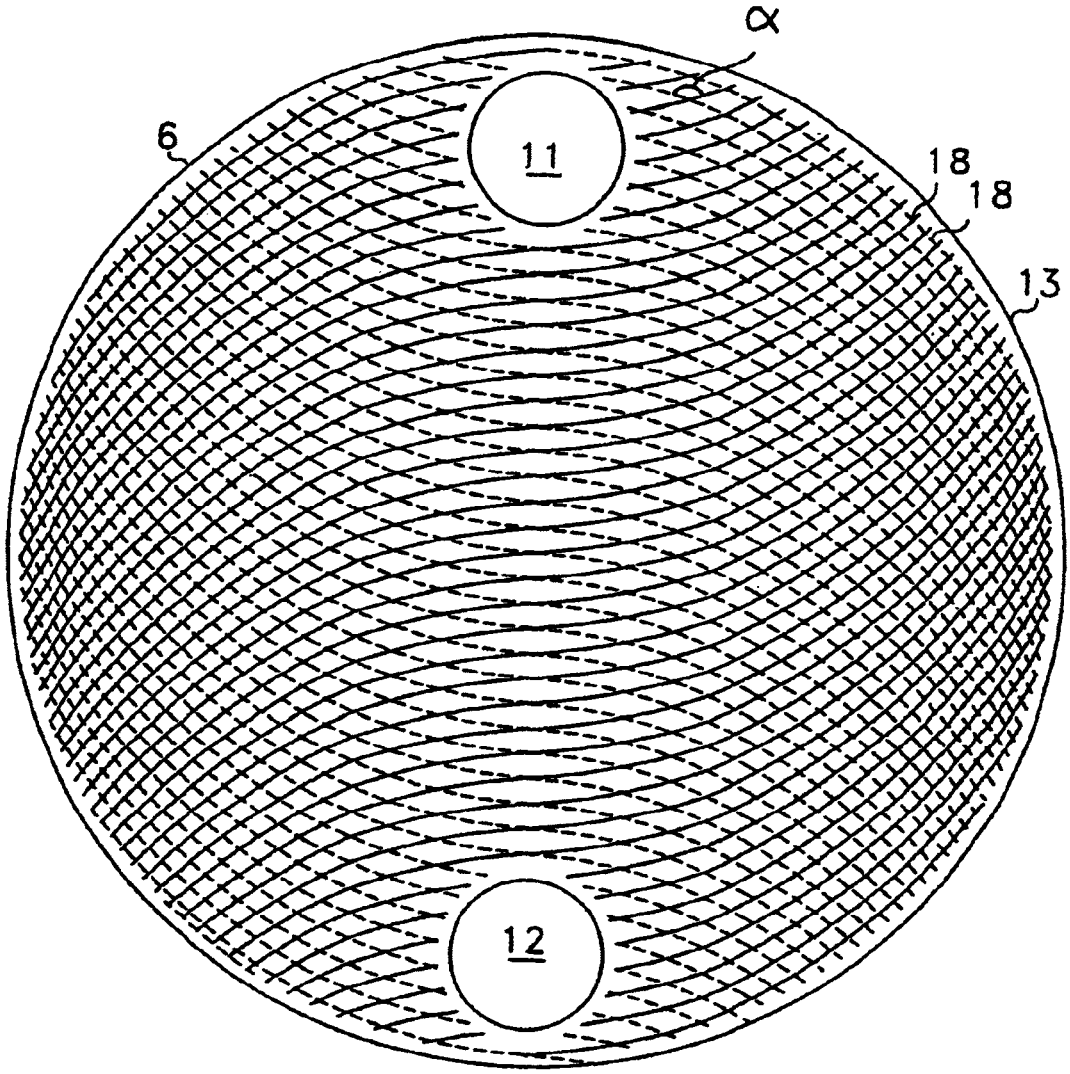

In the following, the invention will be described in more detail with reference to the appended drawing, in which FIG. 1 shows schematically a plate heat exchanger according to the invention seen in a cross section from the side, FIG. 2 shows schematically a top view of a stack of plates consisting of heat transfer plates with a central hole and having a grooving in the shape of a modified evolvent, FIG. 3 shows schematically a top view of a stack of plates consisting of heat transfer plates with a central hole and having a grooving in the shape of a normal evolvent, FIG. 4 shows schematically a top view of a stack of plates consisting of heat transfer plates with a central hole and having a grooving in the shape of a hyperbola, and FIG. 5 shows schematically a top view of a stack of plates consisting of heat transfer plates without a central hole.

FIG. 1 shows a circular plate heat exchanger 1 according to the invention, in a cross-sectional side view. The housing unit 2 used as a pressure vessel for the heat exchanger 1 with plate structure comprises a housing 3 and end plates 4 and 5 which are fixed to the housing 3 in a stationary manner. The housing unit 2 accommodates a stack 6 of plates forming the heat transfer surfaces 10, which stack can be removed for cleaning and maintenance, for example, by connecting one of the ends 4, 5 to the housing 3 by means of a flange joint. A heat transfer medium flowing inside the stack 6 of plates forms a primary stream which is led to the stack 6 of plates via an inlet passage 7 in the end 5 and is discharged via an outlet passage 8 as shown by arrows 9.

The stack 6 of plates forms the heat exchange surfaces of the plate heat exchanger 1, which are composed of circular grooved heat transfer plates 10 connected to each other. The heat transfer plates 10 are connected together in pairs by welding at the outer perimeters of flow openings 11 and 12, and the pairs of plates are connected to each other by welding at the outer perimeters 13 of the heat transfer plates. The flow openings 11 and 12 constitute the inlet and outlet passages of the primary stream inside the stack 6 of plates, through which passages the heat transfer medium is introduced in and discharged from the ducts formed by the heat transfer plates 10.

In the embodiment of FIG. 1, the secondary stream is illustrated with arrows 14. The heat transfer medium of the secondary stream is introduced via an inlet passage 15 in the end 5 to a central duct 16 formed by a central hole in the stack 6 of plates, the heat transfer medium being discharged from the central duct 16 in a radial manner through an outlet passage 17 in the housing 3. In an embodiment of the invention without a central hole, the inlet and outlet passages of the secondary stream are placed in the housing 3, and the flow guides are fitted in the space between the housing 3 and the stack 6 of plates to prevent a by-pass flow.

FIG. 2 shows schematically the stack 6 of plates according to the invention, grooved with modified evolvent curves 18. In the figures, solid lines illustrate the ridges 18 between the grooves formed in one heat transfer plate, and broken lines illustrate ridges 18 of a plate placed against it. The angle between the ridges 18 of these adjacent plates is indicated with the letter $\alpha$. The stack 6 of plates is formed by identical heat transfer plates 10 by turning every second plate in relation to the preceding plate 10 in such a way that two lower or upper surfaces of otherwise identical plates 10 are always placed against each other. The supporting points of the ridges 18 of the pair of plates form pattern elements, such as diamonds or rectangles closely resembling them in such a way that the surface areas of the above-mentioned pattern elements are the same. The angles between the sides in the patterns preferably range from 70° to 110°. The ridge pattern is orthogonal at the mid-point of the radius of the plate surface, and slightly different from orthogonal when moving towards the inner edge 19 or the outer edge 13 of the heat transfer plate 10. The radial flows of fluids are identical in each sector of the circle, whose magnitude is equal to the angle formed by adjacent evolvents; this angle is preferably not greater than a few degrees. Thanks to the almost identical patterning on the whole plate surface, the heat transfer efficiency, calculated per unit of the radius of the heat exchanger 10, is almost constant in all parts of the heat transfer plate 10. A sligth radial decrease in the heat transfer efficiency may occur locally, due to die reduction in the flow rate and in the turbulence caused by the radial movement in the fluid as well as a change in the volume caused by cooling of the gas.

FIG. 3 shows schematically a family of ideal evolvents, in which the points of a single evolvent are determined in a Cartesian coordinate system by a pair of equations, wherein the turn direction is determined by the sign of the formula for calculating the y coordinate:

$$x=\pm r(\cos\Theta+\Theta\sin\Theta)$$

$$y=\pm r(\sin\Theta-\Theta\cos\Theta)$$

in which $\Theta$ is the angle between the line between the point and the origin and the x-axis in radians, and r is the inner radius of the family of graphs. The evolvent families in the cylindrical coordinate system are formed in relation to the origin by turning and copying the graph of a single evolvent turning in both directions, by linear level change. The surface areas of the pattern elements, formed by ideal evolvent families and resembling diamonds, are not constant in the direction of the radius, and the deviations of these pattern elements from the quadratic shape are increased when diverging from the inner radius, and no orthogonal pattern is formed by the intersections of graphs extending in opposite directions. The differences in the surface area of the pattern elements and the deviations of the graphs from the orthogonal system become the larger, the greater the ratio R/r between the radii.

The modified evolvent family formed by grooves and/or ridges 18 therebetween, shown in FIG. 2, has been formed of ideal evolvent families extending in opposite directions by modifying the single graphs in such a way that the surface areas of the rectangular pattern elements are constant and the deviation of the shape from a square is as small as possible, and the curves are as close to the orthogonal system as possible.

The family of hyperbolas formed by grooves and/or ridges 18 therebetween, shown in FIG. 4, is determined in a Cartesian coordinate system by the equation $Y=\pm A/x$, in which the parameter A is varied by a linear level change in both the negative aid the positive range of values, and the term x is a moving variable in the range [−R, R] (R=0), in which R is the outer radius of the graph family. By revolving an identical second graph family, placed on top of the graph family, 45° in relation to the same, a completely orthogonal graph family is obtained, wherein all the curves intersect each other transversely. The patterning of the stack 6 of plates as shown in FIG. 4 is produced by revolving each heat transfer plate by a 10° to 45° phase shift in relation to the preceding heat transfer plate 10. The supporting points of the ridges of the pair of plates form squares or quadrangles closely resembling squares in such a way that the areas of the pattern elements are reduced in the direction of the radius of the plate when moving from the centre of the plate towards the edges. The angles between the sides of the patterns are approximately 90°. The ridge pattern is fully orthogonal. The radial flows of fluids are identical in each 45° sector of the circle, but the flows inside the sector may vary to a slight extent in different passages. As the ridge density is increased, the real surface area of the heat transfer plate 10 in relation to the profile surface area is increased when moving from the inner perimeter to the outer perimeter in the radial direction. This will compensate for a sligth radial decrease in the local heat transfer efficiencies which is due to a reduction in the flow rate and in the turbulence, caused by the radial movement of the fluid, as well as a change in the volume, caused by cooling of the gas. Consequently, the local heat transfer efficiency, calculated per unit of radius of the heat exchanger 1, remains very stable.

FIG. 5 shows a family of graphs consisting of parts of a parabola formed by grooves and/or ridges 18 therebetween, in the shape of an inclined letter S. The parabola equation is changed to another one at point x=0, i.e. at the vertical median line. When the angles αof intersection between the grooves and the ridges 18 are changed in such a way that they find a minimum on the line between small holes, i.e. on the vertical line, that is, when x=0, and a maximum farthermost from said line at points −R, 0 and +R, 0, the pressure loss is the greatest where the flow distance is the shortest, that is, on the straight line between the small holes 11, 12, and the streams can thus be better distributed to the edges. The shape of FIG. 5 is very well suited for use in countercurrent and concurrent heat exchangers. As a cross-flow heat exchanger, this embodiment of the invention may not be as good as the embodiment with a central hole.

The figures and the respective description are only intended to illustrate the present invention. In detail, the method and the device for improving heat transfer in a circular plate heat exchanger, as well as the heat transfer plate, may vary within the scope of the inventive idea presented in the appended claims. It will be obvious for a person skilled in the art that the grooving of the heat transfer plates 10 may be implemented in a way different from that presented above, by using a variety of graph families.

What is claimed is:

1. A method for improving heat transfer in a circular plate heat exchanger (1) composed of circular heat transfer plates (10), in which method the heat transfer takes place between solid, gaseous, liquid or corresponding heat transfer media flowing in the spaces between the heat transfer plates (10) in the circular plate heat exchanger (10), which comprises, in addition to a housing (3) used as a frame (2), also a stack (6) of plates composed of circular grooved heat transfer plates (10), in which stack heat transfer plates (10) are provided, in their central part, with central holes (16), from which the stream of one heat transfer medium is guided to the spaces between the plates, radially in respect to the heat transfer plates (10), or the heat transfer plates (10) are provided with holes (11,12) on opposite sides, from which the stream of one heat transfer medium is guided to a flow in the direction of the perimeter of the circular plate heat exchanger (1), the heat transfer plates (10) are provided with holes (11, 12) on opposite sides, from which the flow of one heat transfer medium is guided to a flow in the direction of the perimeter of the circular plate heat exchanger (1), and the holes (11, 12) on opposite sides of the heat transfer plates (10) and the central hole (16) constitute the inlet or outlet passages for the heat transfer media, characterized in that to improve the heat transfer, the grooving (18) of the circular heat transfer plates is arranged in such a way that the heat transfer medium is guided in a flow in a direction of its radius, primarily along partly curved evolvent graphs or modified evolvent graphs, whereby the heat transfer coefficient of the heat transfer medium of the flow in the radial direction of the circular plate heat exchanger (1) is maintained or increased when moving in the radial direction to the outer perimeter (13) of the heat transfer plate (10).

2. The method according to claim 1 for improving heat transfer in a circular plate heat exchanger (1), characterized in that the radial flow of the heat transfer medium is constant or almost constant at all points of the inner perimeter (19) and at all points of the outer perimeter (13).

3. The method according to claim 1 for improving heat transfer in a circular plate heat exchanger (1), characterized in that to level out the turbulence of streams between the heat transfer media and the heat transfer plates (10), the ridge angle α or the patterning (18) of the heat transfer plates (10) is changed.

4. The method according to claim 1 for improving heat transfer in a circular plate heat exchanger (1), characterized in that the heat transfer medium is guided in a flow in a direction of its radius, primarily along at least partly curved parabolas or hyperbolas.

5. A device for improving heat transfer in a circular plate heat exchanger (1), in which device the heat transfer takes place between solid, gaseous, liquid or corresponding heat transfer media flowing in spaces between heat transfer plates (10) in the circular plate heat exchanger (1), which comprises, in addition to a housing (3) used as a frame (2), also a stack (6) of plates composed of circular grooved heat transfer plates (10), in which stack the heat transfer plates (10) are provided, in their central part, with central holes (16) for guiding the flow of one heat transfer medium to the spaces between the plates, radially in respect to the heat transfer plates (10), or the heat transfer plates (10) are provided with holes (11, 12) on opposite sides for guiding the stream of one heat transfer medium to a stream in the direction of the perimeter of the circular plate heat exchanger (1), the heat transfer plates (10) are provided with holes (11, 12) on opposite sides, from which the stream of one heat transfer medium is guided to a stream in the direction of the perimeter of the circular plate hear exchanger (1), and the holes (11, 12) on opposite sides of the heat transfer plates (10) and the central hole (16) constitute the inlet or outlet passages for the heat transfer media, characterized in that the grooves of the heat transfer plates (10) and/or the ridges (18) therebetween are, in their longitudinal direction, at least partly curved evolvent graphs or modified evolvent graphs, and the grooves and/or ridges (18) in the heat transfer plates (10) of the heat exchangers (I) form a pattern, which is orthogonal or at least as close to it as possible, in two adjacent heat transfer plates (10), wherein the ridge angle α between the grooves and/or ridges (18) of adjacent heat transfer plates varies between 70° and 110°.

6. The device according to claim 5 for improving heat transfer in a circular plate heat exchanger (I), characterized in that the grooves of the heat transfer plates (10) and/or the ridges (18) therebetween are, in their longitudinal direction, at least partly curved parabolas or hyperbolas which form several identical sectors on the circular heat transfer plate (10).

7. The device according to claim 5 for improving heat transfer in a circular plate heat exchanger (1), characterized in that the ideal evolvent shape of the grooves of the heat transfer plates (10) and/or the ridges (18) therebetween has been changed in such a way that the modified evolvent families of the heat transfer plate (10) and of the adjacent heat transfer plate (10), turned 1800 in relation to it, form a grid whose quadrangular elements are almost square at the mid-point of the outer and inner perimeters of the heat transfer plate (10) and diamonds in the vicinity of the outer and inner perimeters, and that the areas of these pattern elements are constant or almost constant over the whole surface of the heat transfer plate (10), and that the number of squares within a radius of the heat transfer plate (10) drawn from the starting point of the curve is an integer N+½.

8. The device according to claim 5 for improving heat transfer in a circular plate heat exchanger (I), characterized in that the family of hyperbolas formed by the grooves of the heat transfer plates (10) and/or the ridges (18) therebetween is constructed in such a way that the hyperbola families of the heat transfer plate (10) and the adjacent heat transfer plate (10) form a grid whose quadrangular elements are square or almost square and the area of these squares is reduced when moving from the inner perimeter to the outer perimeter in the direction of the radius of the heat transfer plate (10).

9. A heat transfer plate (10) comprising at least two holes (11,12) which form inlet or outlet passages for heat transfer media, the heat transfer plate (10) primarily comprising grooves in its plane and ridges (18) therebetween, along which grooves the heat transfer medium is intended to flow between said holes, characterized in that the grooves and/or ridges (18) therebetween are, in their longitudinal direction, at least partly curved evolvent graphs or modified evolvent graphs.

10. A beat transfer plate (10) comprising at least two holes (11, 12) which form inlet or outlet passages for heat transfer media, the heat transfer plate (10) primarily comprising grooves in its plane and ridges (18) therebetween, along which grooves the heat transfer medium is intended to flow between said holes, characterized in that the grooves and/or ridges (18) therebetween are, in their longitudinal direction, at least partly curved parabolas or hyperbolas, which form several identical sectors on the circular heat transfer plate (10).

* * * * *